US006799508B1

(12) United States Patent
Depond

(10) Patent No.: US 6,799,508 B1
(45) Date of Patent: Oct. 5, 2004

(54) INKING DEVICE FOR A FLEXOGRAPHIC PRINTING MACHINE ANILOX ROLL

(75) Inventor: Bernard Depond, Saint Cyprien (FR)

(73) Assignee: Saint Eloi Mecanique Outillage S.A., Cornebarrieu (FR)

( * ) Notice: Subject to any disclaimer, the term of this patent is extended or adjusted under 35 U.S.C. 154(b) by 0 days.

(21) Appl. No.: 10/009,974

(22) PCT Filed: May 9, 2000

(86) PCT No.: PCT/FR00/01240

§ 371 (c)(1),
(2), (4) Date: Jun. 11, 2002

(87) PCT Pub. No.: WO00/68014

PCT Pub. Date: Nov. 16, 2000

(30) Foreign Application Priority Data

May 11, 1999 (FR) ..... 99 06531

(51) Int. Cl.[7] ..... B41F 31/00
(52) U.S. Cl. ..... 101/350.6; 101/366
(58) Field of Search ..... 101/350.1, 350.6, 101/364, 365, 366, 367; 118/123, 124, 125, 126, 413

(56) References Cited

U.S. PATENT DOCUMENTS 4,643,127 A * 2/1987 Wanke ..... 118/126
4,903,632 A * 2/1990 Sollinger ..... 118/123
4,920,913 A * 5/1990 Knop et al. ..... 118/407
5,031,529 A * 7/1991 Greenwood ..... 101/366
5,497,702 A * 3/1996 Gorter ..... 101/366
5,735,209 A * 4/1998 Achelpohl ..... 101/366
5,791,248 A * 8/1998 Atkins ..... 101/350.6
6,024,015 A * 2/2000 Dillig et al. ..... 101/350.6
6,095,045 A * 8/2000 Petersen et al. ..... 101/350.6
6,289,807 B1 * 9/2001 Kutzner et al. ..... 101/350.1
6,293,195 B1 * 9/2001 Allison, Jr. ..... 101/350.6

FOREIGN PATENT DOCUMENTS

| | | |
|---|---|---|
| DE | 4401299 | 7/1995 |
| EP | 0350839 | 1/1990 |
| FR | 2706810 | 12/1994 |

* cited by examiner

*Primary Examiner*—Eugene H. Eickholt
(74) *Attorney, Agent, or Firm*—Horst M. Kasper

(57) ABSTRACT

The invention concerns an inking device, called doctor blade chamber, for a flexographic printing machine anilox roll (2). Said doctor blade chamber, which comprises a closed box (4, 6) borne mobile (10) by a frame (8) for being sealingly pressed against anilox roll (2), box (4, 6) defining a main chamber equipped with a couple of positive (16) and negative (18) blades. The invention is characterized in that the main chamber, equipped with means (32, 34) for being the seat of ink circulations at atomsphere pressure, is divided into two superposed chambers (20, 22) communication with each other through channels (24) circulating ink by simple gravity, from an upper supply chamber (20) to a lower delivery chamber (22), the two chambers (20, 22) being separated from each other by retaining blade (26) which provides an ink reserve (28) between two chambers (20, 22) and upstream of the negative blade (18).

7 Claims, 1 Drawing Sheet

INKING DEVICE FOR A FLEXOGRAPHIC PRINTING MACHINE ANILOX ROLL

Figure 1:
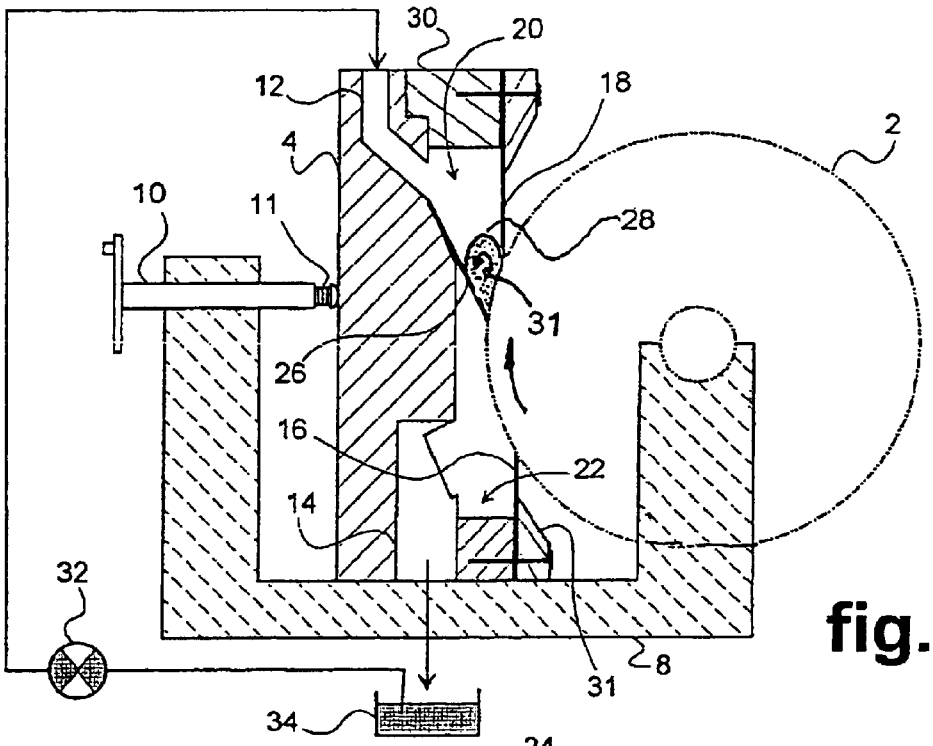

The invention relates to the field of flexographic printing machines and the object of the invention is the device called doctor blade chamber for the inking of an anilox roll.

The printing groups of the flexographic printing machines comprise a roller called anilox roll furnished for the inking of a plate supported by another roll called plate holder. The inking of the plate is performed by a transfer of the ink from the anilox roll to the holder plate.

A problem to resolve comprises the inking of the anilox roll. In the running fashion the anilox roll furnishes a cellular outer surface for the receipt of the ink.

One knows a first mode of inking an anilox roll, comparatively old, which consists in having the anilox roll dabble in a bath of ink. At least one intermediate roll is interposed between the anilox roll and the plate holder in order to obtain a suitable and proper distribution of the ink over the complete surface of the plate. A major inconvenience of this mode of inking comprises its complexity and the splashes of ink which result from the dampening and which are making it necessary to protect the space surrounding the anilox roll by a careenage.

In order to relieve this inconvenience devices called doctor blade chambers have been proposed for the inking of the anilox rolls. These devices comprise a sealed box permanently filled with ink and disposed on the side of the anilox roll in such a way to envelope a portion of the rotating surface of the anilox roll. A circulation of the ink in the interior of the box maintains the homogeneity of the ink. According to various variations, the ink is drained out of the box be it by using directly the rotary motion of the anilox roll or be it by associating here different reflux means. The sealing between the box and the anilox roll is obtained on the one hand at the ends of the anilox roll by a pair of cheeks furnished with sealing members and on the other hand along the anilox roll by at couple of scraper blades disposed respectively upstream (positive scraper blade) and downstream (negative scraper blade) of the inking zone of the anilox roll, wherein the negative scraper blade is in addition destined to smoothe ink on the surface of the anilox roll.

A first inconvenience of this type of device is based on a random inking of the exterior surface of the anilox roll and on an irregular distribution of the ink on the anilox roll caused by the prevailing pressure in the box which does not favor a proper and suitable filling of the cells.

A second inconvenience flows from the circulation of the ink under pressure in the interior of the box, which imposes important limitations with respect to the sealing between the box and the anilox roll, in particular at the ends of the latter anilox roll, and the frequent replacement of the sealing members requires a detrimental stop in the operation of the machine.

It is an object of the invention to furnish a device of the kind of said doctor blade chamber for the inking of an anilox roll of a flexographic printing machine, which guarantees a homogeneous inking of the anilox roll and the structure of which renders the maintenance of the device quick and easy.

The inventive path has comprised starting with the statement referred to above and in meeting the customs taken in the field, to propose a doctor blade chamber wherein the ink circles naturally by gravity in the interior of the doctor blade chamber, from a supply chamber wherein the ink is brought out to a discharge chamber, and wherein the ink flows out of said discharge chamber. A retaining blade is interposed between the two said chambers and the overhang of the discharge chamber in order to furnish an obstacle to the natural circulation of the ink and to manage a retention of the ink, which ink is preferably naturally conducted from the reserve up to upstream of the negative blade under the effect of the rotation of the anilox roll. Circulation channels of the ink allow an escape of the ink outside of the reserve toward the discharge chamber in order to maintain the natural circulation of the ink between the two chambers even though the retaining reserve blade is present.

These arrangements are such that in the first place the circulation of the ink in the interior of the doctor blade chamber is not forced and is effected at atmospheric pressure and in the second place that the cushion pad of ink formed upstream of the negative blade does not cause any unsuitable thrust pressure on the ink of the kind present in the prior art wherein the ink circulates without pressure in the interior of the box. There results a homogeneous inking and a uniform and constant smoothing of the anilox roll and finally a suitable and proper distribution of the ink on the entirety of the periphery of the anilox roll.

It is observed that the selection of a blade as a hindrance member to the natural flow of the ink in the interior of the box is preferred based on the fact that the said blade is not only suitable to manage the retaining of the ink, but also, and then called distributor, is suitable to furnish a proper and suitable distribution of the ink on the anilox roll and wherein an equivalent member, which performs only the function of a hindrance to the natural flow of the ink, can be substituted for said blade for departing so much from the general rule of the invention, however in this case a distribution member of the ink on the anilox roll has to be associated with the blade.

In other words, one understands that the retaining blade is intended not only to manage the retaining of the ink upstream of the negative blade but also, called also distributor, to distribute and to smoothe the ink on the anilox roll.

The applicants propose according to the inventive concept to close the end faces of the box of the doctor blade chamber by means of cheeks or side plates, in particular made of nylon, and held in simple contact against the end faces of the anilox roll, wherein the said cheeks or side plates form not only the end wall of the box but also form by themselves sealing members between the box and the anilox roll; it is noted that the seal is obtained in this fashion thanks to the circulation by simple gravity of the ink in the interior of the box.

Finally and according to an advantageous embodiment, the negative blade is joined to the box by the intermediary of a detachable support for offering an easy access to the interior of the doctor blade chamber, in particular with regard to the cleaning of the doctor blade chamber, and for the purpose of allowing a quick and easy replacement of the negative blade by a replacement of the support by another support previously furnished with the blade, without having to interrupt for a long time the functioning of the machine and without having to change the position of the doctor blade chamber relative to the anilox roll and therefore to have to empty this latter doctor blade chamber.

Figure 2:
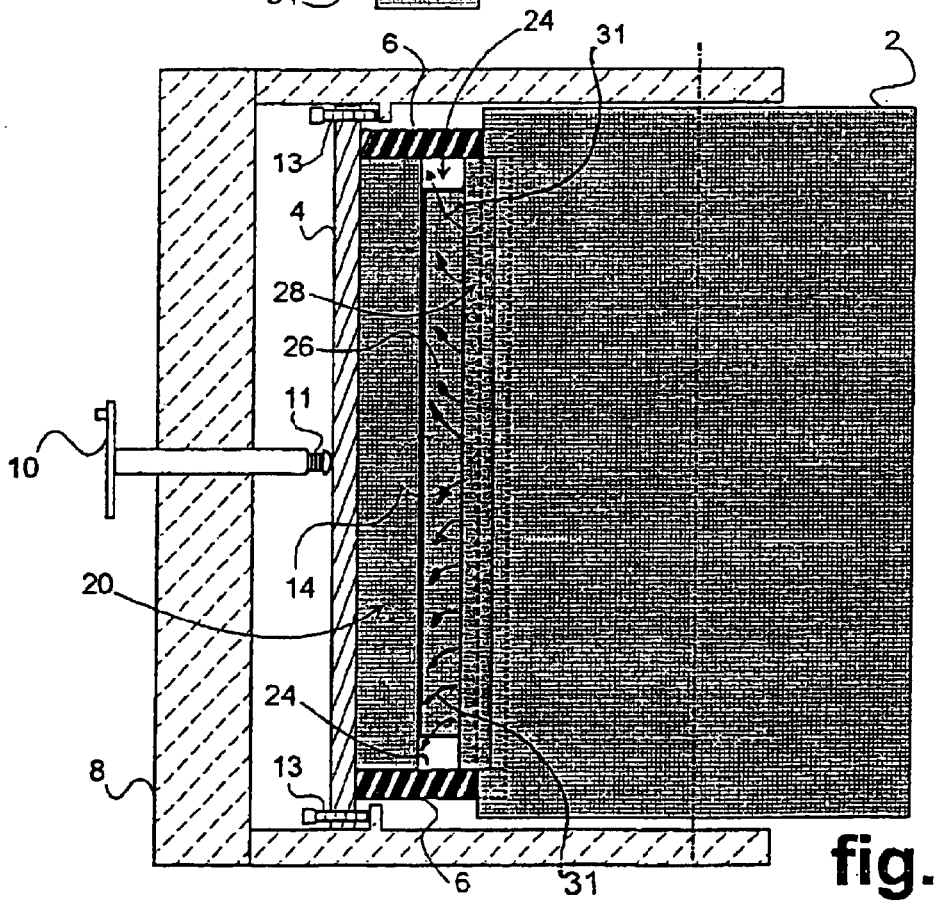

The present invention will be better comprised and the relevant details will appear in the description which shows how to make a preferred embodiment of the actual realization with respect to the figures of the annexed sheets, wherein:

FIG. 1 is a schematic view in a transverse section of an inking device according to a preferred embodiment of the realization of the invention, FIG. 2 is a schematic view from the top of the interior of a doctor blade chamber of an inking device illustrated in the preceding figure.

An inking device called doctor blade chamber of a rotating drum 2 called the anilox roll of a machine for flexographic printing comprises a box 4,6 closed in longitudinal direction. This box is supported by a frame 8 through the intermediate of a moving means 10 for its application against the anilox roll 2 by way of enclosing a portion of its revolution surface, called inking zone, in a sealing fashion. The box 4,6 defines and delimits an interior space called principal chamber and intended for the purpose of being the seat of an ink circulation and is furnished for this purpose with a feeding conduit 12 for the ink and with a discharge conduit 14 for the ink. The box 4,6 is additionally furnished with a pair of longitudinal blades 16 and 18, called positive for the blade 16 intended to be located upstream of the inking zone and, respectively, negative for the blade 18 intended to be located downstream of the inking zone.

The main chamber furnished with means 32,34 for being the place of an ink circulation at atmospheric pressure is subdivided in two superposed chambers 20 and 22 communicating between themselves by channels 24 for the ink circulation by simple gravity, from the upper chamber 20 called supply chamber toward the lower chamber 22 called discharge chamber, wherein the said two chambers 20 and 22 are separated one from the other by a blade 26, called retaining blade, for managing an ink reserve between the two chambers 20 and 22 and upstream of the negative blade 18. These arrangements are such that the ink can circulate by simple gravity in the interior of the box 4,6 and that a retaining of ink 28 is managed for the purpose of inking of the anilox roll 2.

According to a preferred embodiment of the invention illustrated in the figures, the said circulation channels 24 for the ink are formed by a passage lead outside of the ends of the retaining blade 26, between this latter retaining blade 26 and the end wall 6 of the box.

Preferably and thanks to the ink circulation at atmospheric pressure, the end faces of the box 4,6 are formed by cheeks or side plates 6 intended to be applied with sliding contact against the corresponding end faces of the anilox roll 2, wherein the said cheeks or side plates 6 form by themselves sealing members between the box 4,6 and the anilox roll 2.

According to a preferred embodiment of the invention realization, the negative blade 18 is supported on the box 4,6 by the intermediate of a detachable support 30 of the kind that the negative blade 18 can be extracted from the box 4,6 by withdrawal of the support 30 without requiring a global movement of the doctor blade chamber by putting into position its mobility means 10.

Preferably the retaining blade 26 forms together with retention of the anilox roll 2 a closed angle A between 5 and 15 degrees and opening itself relative to the negative blade 18 and taken at the contact point between the retaining blade 26 and the anilox roll 2.

It is understood that in a usual manner anyone at least of the positive blade 16, the negative blade 18, and the retaining blade 26 is furnished with a regulation of the contact pressure which are intended to be exerted on the anilox roll 2 (not illustrated in the figures).

Nevertheless it is noticed in this regard that thanks to the circulation of the ink in the interior of the box 4,6 by natural flow at an atmospheric pressure and in contrast to the doctor blade chambers of the prior art, the positive blade 16 cannot be in contact with the anilox roll 2 without for as much allowing a plentiful escape of the ink outside of the box 4,6 in this zone.

The prevailing atmospheric pressure in the interior of the box 4,6 by an ink inlet is obtained by guiding by means of a pump 32, from a reserve 34 up to the interior of the supply chamber 20 and through the feed conduit 12 according to the example shown in FIG. 1. The ink flows to the retaining blade 26 and forms then the ink reservoir 28. The anilox roll is inked and the ink flows through the passage 24 to the discharge chamber 22, then flows through the discharge channel 14 up to the reserve container 34. It is understood that this example of a feeding the doctor blade chamber of the invention is not limiting and that other solutions can be foreseen without so much deviation from the general rule of the invention expressed above.

According to recent changes of the realization, the doctor blade chamber is formed by a profiled aluminum body with side connections made out of plastic and with adjustable supports for the blade. The realization profits by a distributor made out of plastic which creates a "corner" of ink allowing the good stuffing of the cells of the anilox roll with the purpose that the surplus be not recovered by the negative blade.

This surplus is discharged by the passages at the end of the distributor and by a deepening of the chamber at the same level relative to a second chamber, which second chamber is rendered sealed by the positive blade. Finally a recovering spout allows to bring back the ink toward the pump.

The distributor levels the anilox roll in order to allow the ink to "hit hard" the anilox roll by a hydro dynamic phenomenon. The lower blade is now distant and moved back by 5/10 mm relative to the anilox roll. Effectively, this blade is not set for issuing a good distribution of the ink on the cells, and the sealing of the chamber remains maintained until the ink does not descend on this zone of the blade. The withdrawal of this blade allows to reduce the use of the anilox roll which is only scraped one time, and it allows equally to use only one single blade. Furthermore there is no further dirtying of the blade by the ink which is not transferred onto the plate. Effectively, the surface tension of the ink relative to the ceramics covering makes that one obtains a "bulge or belly" on the top side of the cell. The cells which do not transfer ink onto the plate are nevertheless scraped without purpose by the inferior blade.

At the level of the distributor, the ink arrives in a reverse sense of direction relative to the rotation of the anilox roll. Thus the ink "hits hard" really on the cells; this allows a complete renewal of the ink. It is the rotation speed of the anilox roll which creates the suppression in the cells.

The ink which is not residing in the cells is dragged toward the top of the blade 18, and the ink forms in this way a vortex (arrow 31) which discharges on the sides perpendicular to the passages 24. The obtaining of this vortex allows a good distribution of the ink over the complete area of the anilox roll, and a perfect renewal of the ink in the cells. This vortex is a helix with a decreasing step when the viscosity of the ink increases and also when the speed decreases.

Thanks to the totality of the old and new arrangements, the doctor blade chamber works at atomspheric pressure, which allows to avoid constraints on the anilox roll and also to preserve the anilox roll of a premature wear, with a perfect distribution of the ink even at high speeds of peripheral movement (higher than 300 meters per minute), even in case of fatty inks.

What is claimed is:

1. Inking device having a rotary drum (2), called anilox roll, of a flexographic printing machine, of the kind of a device called doctor blade chambers comprising a closed box (4,6) extending longitudinally and supported by a frame (8) by the intermediary of a moving means (10), for the application of the moving means (10) against the anilox roll (2) in the kind of enveloping in a sealing way one part of the rotation surface of the anilox roll (2), called inking zone, wherein the said box (4,6) defines and delimits an interior space, called principal chamber, intended to be the place of a circulation of the ink and being furnished for this purpose with a feeding conduit (12) for the ink and with a discharge conduit (14) for the ink, as well as a pair of longitudinal blades, called positive blade (16) for that blade intended to be located upstream of the inking zone and, respectively, negative blade (18) for that blade located downstream of the inking zone, characterized in that the principal chamber is furnished with means (32, 34) for providing the place of an ink circulation at atmospheric pressure and is divided into two superposed chambers (20, 22) communicating between themselves by ink circulation channels (24) by simple gravity, from the upper chamber (20), called supply chamber, relative to the lower chamber (22), called or discharge chamber, wherein the two said chambers (20, 22) are separated one from the other by a blade (26), called retaining blade, for furnishing an ink reservoir (28) between the two chambers (20, 22) and upstream of the negative blade (18), of such kind that the ink can circulate by simple gravity in the interior of the box (2,4) and that a reservoir of the ink (28) is furnished for the inking of the anilox roll (2).

2. Device according to claim 1 characterized in that the said circulation channels (24) are formed by a passage furnished outside and beyond of the ends of the retaining blade (26), between this latter retaining blade (26) and the end wall (6) of the box.

3. Device according to claim 1 characterized in that the end faces of the box (4, 6) are formed by cheeks or side plates (6) intended to be applied in sliding contact against the corresponding end faces of the anilox roll (2), wherein said cheeks or side plates (6) form by themselves sealing members between the box (4,6) and the anilox roll (2).

4. Device according to claim 1 characterized in that the negative blade (18) is supported on the box (4,6) by the intermediary of a detachable support (30), in such a way that the negative blade (18) can be extracted from the box (4,6) by withdrawal of the support without requiring a global replacement of the doctor blade chamber.

5. Device according to claim 1 characterized in that the retaining blade (26) forms a closed angle A contained between five degrees and 15 degrees and opening toward the negative blade (18) together with the tangent of the anilox roll taking at the point of contact between the retaining blade (26) and the anilox roll (2).

6. Device according to claim 1 characterized in that anyone at least of the positive blade (16), negative blade (18), and of the retaining blade (26) is furnished with a means for controlling the contact pressure which the respective blade is intended to exert on the anilox roll (2).

7. Device according to claim 1 characterized in that the moving means (10) of the box (4) comprises a member (11) exerting an elastic pressure on the box relative to the anilox roll (2), wherein the box (4) takes support under the effect of the set elastic pressure, against the frame (8) by the intermediary of a controllable thrust (13) with which the box (4) is furnished.

* * * * *